US012539537B2

(12) United States Patent
Tebbe

(10) Patent No.: US 12,539,537 B2
(45) Date of Patent: Feb. 3, 2026

(54) MATERIAL, APPARATUS, AND METHOD FOR REFRACTORY CASTINGS

(71) Applicant: WAGSTAFF, INC., Spokane Valley, WA (US)

(72) Inventor: Nicholas Ryan Tebbe, Spokane Valley, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 18/780,700

(22) Filed: Jul. 23, 2024

(65) Prior Publication Data

US 2024/0375171 A1 Nov. 14, 2024

Related U.S. Application Data

(63) Continuation of application No. 17/449,121, filed on Sep. 28, 2021, now abandoned.

(60) Provisional application No. 63/121,436, filed on Dec. 4, 2020, provisional application No. 63/089,130, filed on Oct. 8, 2020.

(51) Int. Cl.
*B22D 7/06* (2006.01)
*B22C 1/18* (2006.01)

(52) U.S. Cl.
CPC ..... *B22C 1/183* (2013.01); *B22D 7/068* (2013.01)

(58) Field of Classification Search
CPC ..... B22D 7/068; B22D 35/00; B22D 35/02; B22D 35/04; B22D 35/06; B22C 1/183
See application file for complete search history.

(56) References Cited

U.S. PATENT DOCUMENTS 1,823,873 A 9/1931 Brace
1,922,029 A 8/1933 Chestnut et al.
3,970,817 A 7/1976 Boyd
(Continued)

FOREIGN PATENT DOCUMENTS

CN 1252018 A 5/2000
CN 1781626 A 6/2006
(Continued)

OTHER PUBLICATIONS

Office Action for Ukraine Patent Application No. 2023-01692 dated Dec. 25, 2024 w/English translation (6 pages).
(Continued)

*Primary Examiner* — Keith Walker
*Assistant Examiner* — Steven S Ha
(74) *Attorney, Agent, or Firm* — ALSTON & BIRD LLP

(57) ABSTRACT

Provided herein is a system, apparatus, and method for producing refractory products, and more particularly, to producing heated refractories, passive refractories, transition plates, moldable refractories, and accessories such as heated spouts, heated pins, thimbles, and dams. A heated refractory channel as disclosed herein may include a working surface to contain molten metal within the channel; a core adjacent to the working surface; one or more heating elements disposed within the core; and insulation, where the core is disposed between the working surface and the insulation. The one or more heating elements may be molded into the core. The heating elements may be electrical resistance heating elements.

11 Claims, 9 Drawing Sheets

(56) References Cited

U.S. PATENT DOCUMENTS

| | | | |
|---|---|---|---|
| 4,949,420 | A | 8/1990 | Eustache |
| 4,975,563 | A | 12/1990 | Roebuck et al. |
| 5,033,721 | A | 7/1991 | Gnyra |
| 5,061,526 | A | 10/1991 | Pierre |
| 5,316,071 | A | 5/1994 | Skinner et al. |
| 5,361,183 | A | 11/1994 | Wiese |
| 5,642,248 | A | 6/1997 | Campolo et al. |
| 5,947,716 | A | 9/1999 | Bellamy et al. |
| 6,084,207 | A | 7/2000 | Jones |
| 6,107,611 | A | 8/2000 | Jones |
| 6,218,647 | B1 | 4/2001 | Jones |
| 6,303,905 | B1 | 10/2001 | Chiles et al. |
| 6,444,165 | B1 | 9/2002 | Eckert |
| 6,958,463 | B1 | 10/2005 | Kochman et al. |
| 6,973,955 | B2 | 12/2005 | Tingey et al. |
| 7,033,538 | B2 | 4/2006 | Eckert |
| 8,883,070 | B2 | 11/2014 | Reeves et al. |
| 9,095,896 | B2 | 8/2015 | Vincent |
| 9,248,497 | B2 | 2/2016 | Vincent |
| 9,781,776 | B2 | 10/2017 | Vincent |
| 9,845,270 | B2 | 12/2017 | Vincent |
| 9,993,870 | B2 | 6/2018 | Tremblay |
| 10,099,285 | B2 | 10/2018 | Vincent |
| 2002/0048305 | A1 | 4/2002 | Eckert |
| 2005/0247700 | A1 | 11/2005 | Kochman et al. |
| 2008/0007880 | A1 | 1/2008 | Bradley et al. |
| 2009/0020567 | A1 | 1/2009 | Numano et al. |
| 2011/0140318 | A1 | 6/2011 | Reeves et al. |
| 2011/0216451 | A1 | 9/2011 | Haines et al. |
| 2012/0140362 | A1 | 6/2012 | Robins et al. |
| 2013/0334744 | A1* | 12/2013 | Tremblay ..... B22D 41/015 266/200 |
| 2014/0319188 | A1 | 10/2014 | Kusic |
| 2016/0366727 | A1 | 12/2016 | Vincent et al. |
| 2018/0172351 | A1 | 6/2018 | Ofallon et al. |
| 2022/0111434 | A1 | 4/2022 | Tebbe |

FOREIGN PATENT DOCUMENTS

| | | | |
|---|---|---|---|
| CN | 101041178 | A | 9/2007 |
| CN | 102519258 | A | 6/2012 |
| CN | 104006646 | A | 8/2014 |
| CN | 104114302 | A | 10/2014 |
| CN | 104421937 | A | 3/2015 |
| CN | 106457377 | A | 2/2017 |
| CN | 111704440 | A | 9/2020 |
| DE | 2331137 | A1 | 1/1974 |
| DE | 102012102549 | A1 | 5/2013 |
| EP | 0141688 | A1 | 5/1985 |
| GB | 1440265 | | 6/1976 |
| JP | 62-084864 | | 4/1987 |
| JP | S63-6769 | A | 1/1988 |
| JP | 01131079 | | 5/1989 |
| JP | H03-042354 | | 2/1991 |
| JP | 2000-210761 | | 8/2000 |
| JP | 2001-339842 | A | 12/2001 |
| JP | 2010-029895 | A | 2/2010 |
| JP | 2013-512780 | | 4/2013 |
| KR | 10-0914031 | B1 | 8/2009 |
| RU | 2107237 | C1 | 3/1998 |
| RU | 2303744 | C2 | 7/2007 |
| RU | 2304600 | C2 | 8/2007 |
| RU | 70173 | U1 | 1/2008 |
| RU | 2358831 | C2 | 6/2009 |
| RU | 2549232 | C2 | 4/2015 |
| RU | 2549817 | C2 | 4/2015 |
| SU | 376993 | A1 | 3/1978 |
| SU | 628991 | A1 | 10/1978 |
| TW | 1267548 | B | 12/2006 |

OTHER PUBLICATIONS

Office Action for Japan Patent Application No. 2023-521580 dated Dec. 2, 2024 w/English translation (4 pages).

Search Report for UAE Application No. P6000787/2023 received Nov. 22, 2024 (2 pages).

Examination Report for UAE Application No. P6000787/2023 issued Nov. 19, 2024 (6 pages).

Office Action for China Patent Application No. 202180069144.0 dated Nov. 28, 2024, w/English translation (18 pages).

International Search Report and Written Opinion for International Application PCT/US2024/024925 (ISA/EP) mailed Aug. 2, 2024 (14 pages).

International Search Report and Written Opinion for International Application PCT/US2021/053716 (ISA/EP) mailed May 23, 2022 (17 pages).

Search Report for Russian Patent Application No. 2023111439/05(024444) dated Apr. 16, 2024 w/English translation (6 pages).

Office Action for Russian Patent Application No. 2023111439/05 (024444) dated Apr. 17, 2024 (8 pages).

1st Office Action for China Patent Application No. 202180069144.0 dated Jan. 24, 2024 w/English translation (26 pages).

English translation of Office Action issued for Japan Patent Application No. 2023-521580 mailed May 13, 2024 (8 pages).

Office Action for Taiwan Patent Application No. 110137266 dated Sep. 25, 2025, w/English translation (16 pages).

* cited by examiner

MATERIAL, APPARATUS, AND METHOD FOR REFRACTORY CASTINGS

CROSS-REFERENCE TO RELATED APPLICATIONS

This application is a continuation of and claims priority to U.S. patent application Ser. No. 17/449,121, filed on Sep. 28, 2021, which claims priority to U.S. Provisional Application Ser. No. 63/121,436, filed on Dec. 4, 2020, and U.S. Provisional Application Ser. No. 63/089,130, filed on Oct. 8, 2020, the contents of each of which are hereby incorporated by reference in their entirety.

TECHNOLOGICAL FIELD

The present disclosure relates to a system, apparatus, and method for producing refractory products, and more particularly, to producing heated refractories, passive refractories, T-plates, moldable refractories, and accessories such as heated spouts, heated pins, thimbles, and dams.

BACKGROUND

Metal products may be formed in a variety of ways; however numerous forming methods first require an ingot, billet, or other cast part that can serve as the raw material from which a metal end product can be manufactured, such as through rolling, extrusion, or machining, for example. One method of manufacturing an ingot or billet is through a continuous casting process known as direct chill casting, whereby a vertically oriented mold cavity is situated above a platform that translates vertically down into a casting pit. A starter block may be situated on the platform and form a bottom of the mold cavity, at least initially, to begin the casting process. Direct chill casting may be performed with multiple mold cavities whereby molten metal is distributed to the various mold cavities. Problematically, molten metal introduced at one side of an array of mold cavities cools to different temperatures by the time it reaches mold cavities further from the molten metal source. Molten metal is supplied to the mold cavities using a refractory channels, where channels are formed of a refractory material that is resistant to heat and reduces the heat loss of the molten metal as it travels along the refractory channel due to the properties of the refractory material. However, heat loss of the molten metal may still be significant, particularly across a mold frame having a plurality of mold cavities. Further, metal temperatures drop from the furnace to the table in the furnace launder. These furnace launders that carry molten metal from the furnace to the billet table may be on the order of 100 feet in some cases.

Temperature variation between the furnace and the various billet mold cavities presents problems. Temperature variance often occurs over the duration of the cast, where the refractory is initially cold, but heats up as the cast progresses such that the metal initially loses a substantial amount of heat to the refractory. Toward the end of the casting process, the refractory has been heated by the heat removed from the metal such that less heat is lost from the metal, resulting in temperature variation of the temperature of the metal at the molds during the casting process. Temperature also varies from one cast to another. The refractory may have residual heat at the start of a second casting operation such that the temperatures will be different from the first casting operation. Temperature of the molten metal tends to drop as heat is lost from the metal without compensatory heat. Temperature variance can be on the order of 50° C. from the furnace launder, which is detrimental to casting. The error in the temperature itself can be harmful as is the variability of that error.

Molten metal is supplied to the mold cavities through one or more refractory channels and is distributed to the mold cavity whereupon the molten metal cools, typically using a cooling fluid. The platform with the starter block thereon may descend into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

BRIEF SUMMARY

The present disclosure relates to a system, apparatus, and method for producing refractory products, and more particularly, to producing heated refractories, passive refractories, T-plates, moldable refractories, and accessories such as heated spouts, heated pins, thimbles, and dams. Embodiments provided herein include a heated refractory channel including: a working surface to contain molten metal within the channel; a core adjacent to the working surface; one or more heating elements disposed within the core; and insulation, wherein the core is disposed between the working surface and the insulation. According to some embodiments, the one or more heating elements are molded into the core. The core may define one or more channels molded therein configured to receive the one or more heating elements. The one or more heating elements may include electrical resistance heating elements. The working surface of some embodiments is configured to be heated to more than 300° C. by the one or more heating elements. The one or more heating elements may be maintained at less than 1,000° C.

According to an example embodiment, the electrical resistance heating element may be formed into a coil, where the coil is formed within the core around a trough of the heated refractory channel. The core may include a refractory material including at least half of a percent of microbubbles by weight. The microbubbles comprise hollow glass bubbles with a diameter of around 60 micrometers.

Embodiments of the present disclosure may provide a refractory material for forming refractory components for casting metal including: at least one of colloidal silica or colloidal alumina; silica aggregate; fiber; and microbubbles, where the density of the refractory material is less than 1,200 kilograms per cubic meter. The microbubbles may make up at least half of one percent of the material by weight. The colloidal silica may be at least fifty percent by weight of the material. The refractory material may be formed into a transition plate for direct chill casting. The refractory material may be about 90% silica aggregate by volume. The material may include more than one percent microbubbles by weight. The fiber may be a ceramic fiber used for reinforcement.

Embodiments provided herein include a heated refractory channel including: a working surface; a core adjacent to the working surface; a backer adjacent to the core; one or more heating elements disposed between the backer and the core; and insulation adjacent to the backer, where the core is disposed between the working surface and the backer. The backer may be bonded to the core. The heating element may be sealed between the backer and the core to shield the heating element from molten metal.

Embodiments provided herein may include a refractory material for use in molding refractory components, repairing refractory components, or joining refractory components, the material including: a binder material; a filler material; a reinforcing material; and at least half of a percent of microbubbles by weight. The material may have a density of less than 1,200 kilograms per cubic meter. The reinforcing material may include a ceramic fiber.

Embodiments provided herein may include a heated refractory component including: a working surface to hole or to guide molten metal; a core adjacent to the working surface; one or more heating elements disposed within the core; and insulation, where the core is disposed between the working surface and the insulation. The heated refractory component may include at least one of a spout, a thimble, a pin, a dam, a transition plate, or a channel.

Embodiments provided herein may include a transition plate for direct chill casting, where the transition plate is formed of a material including at least 90% silica by weight and has a density of less than 1,200 kilograms per cubic meter. The material may include at least 0.25% microbubbles by weight. The material may include salt to cause the material to gel when forming the transition plate.

BRIEF DESCRIPTION OF THE DRAWINGS

Figure 1:
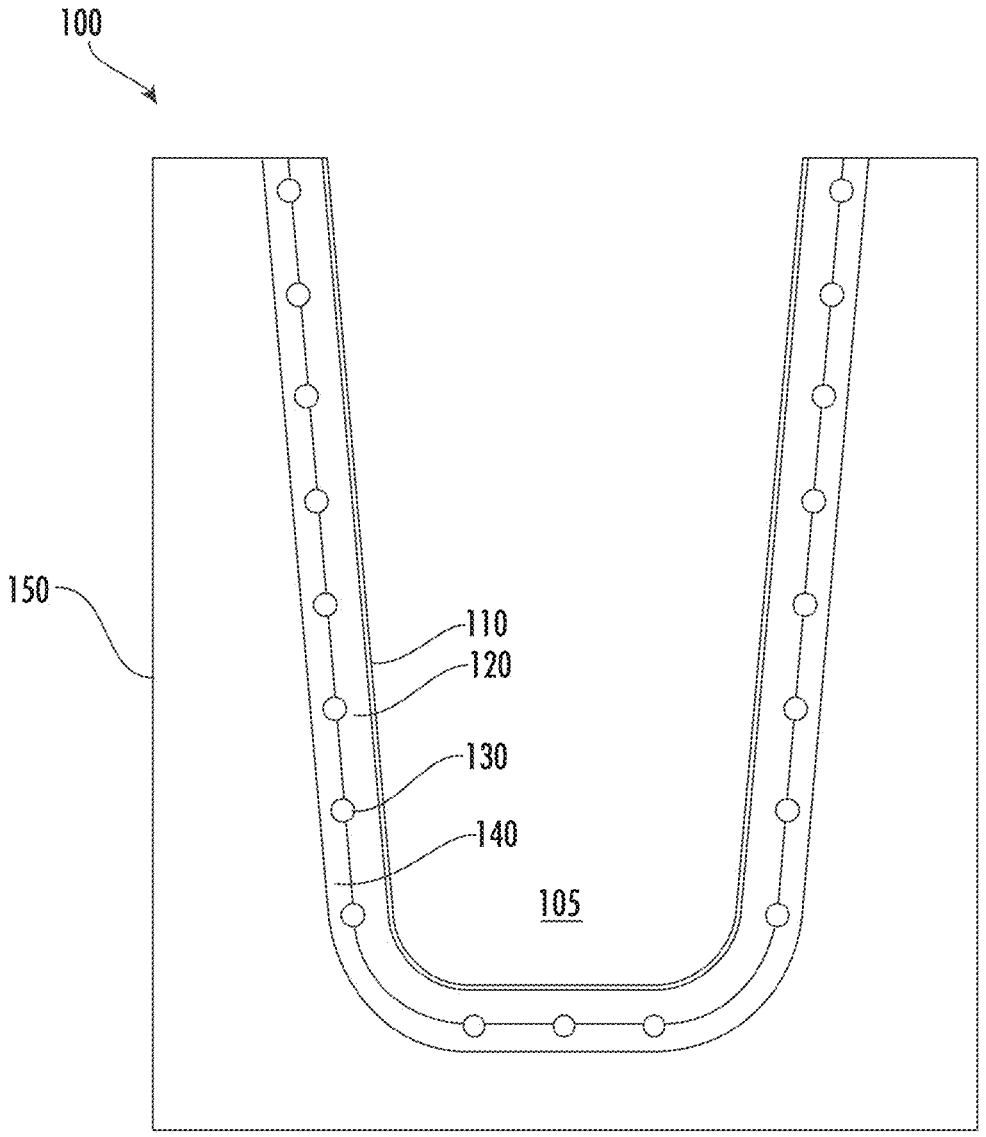
Figure 2:
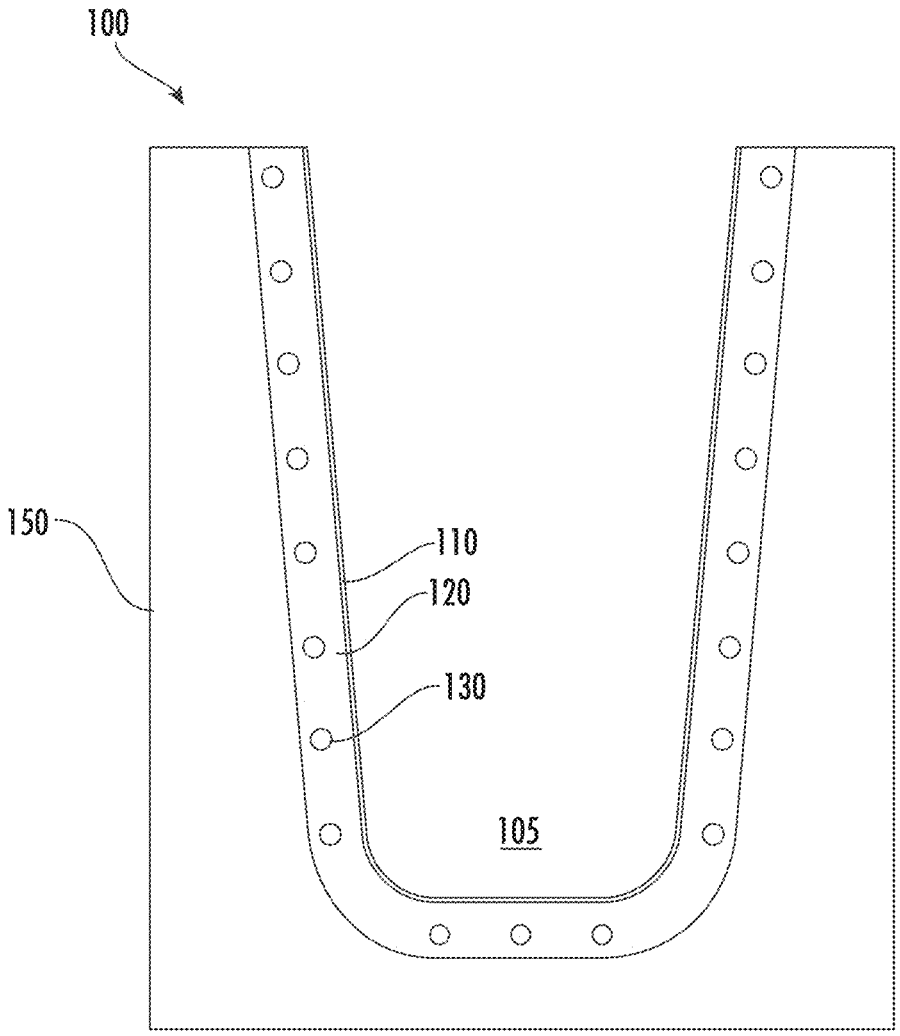
Figure 3:
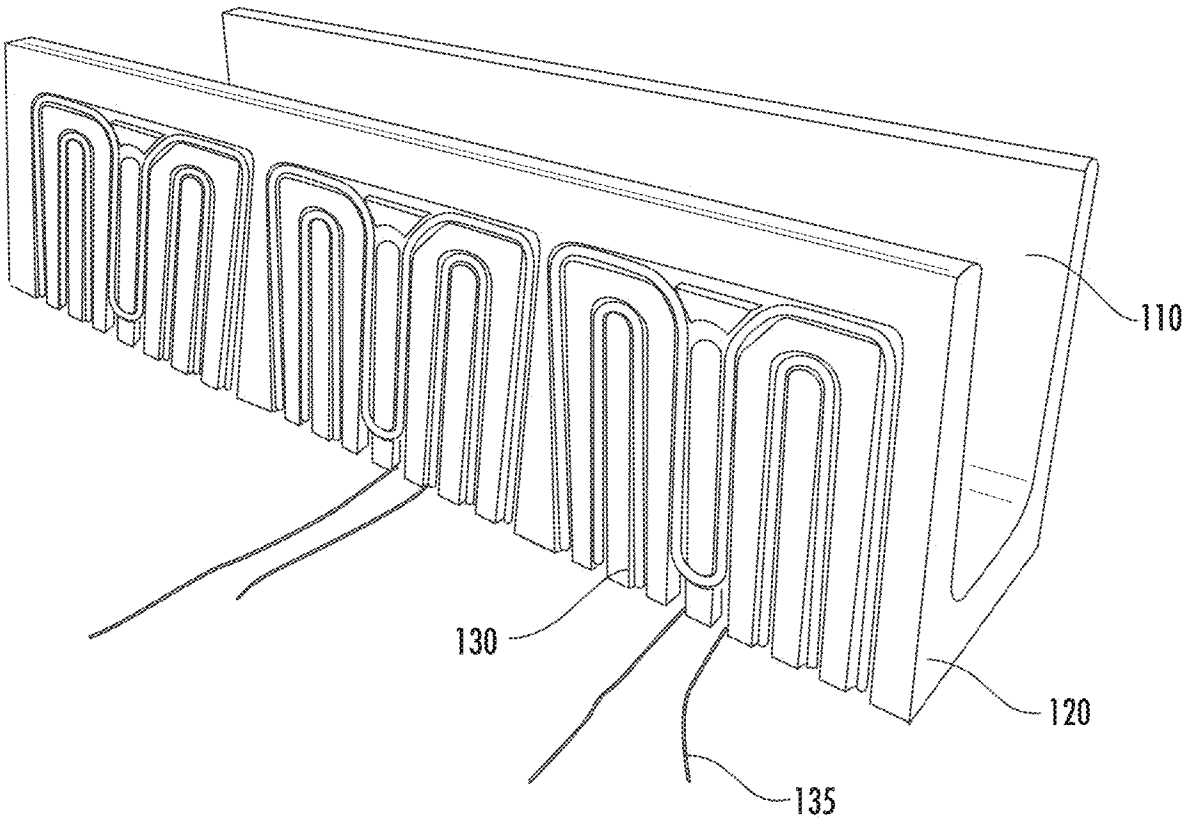
Figure 4:
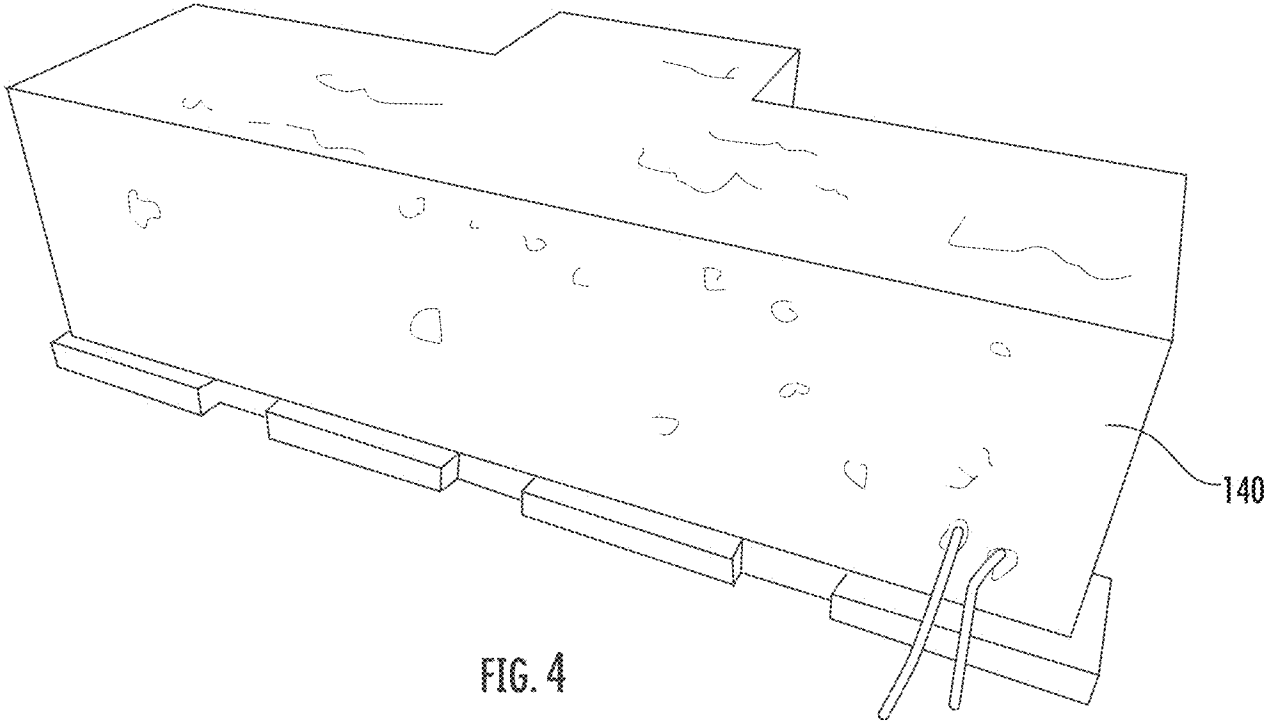
Figure 5:
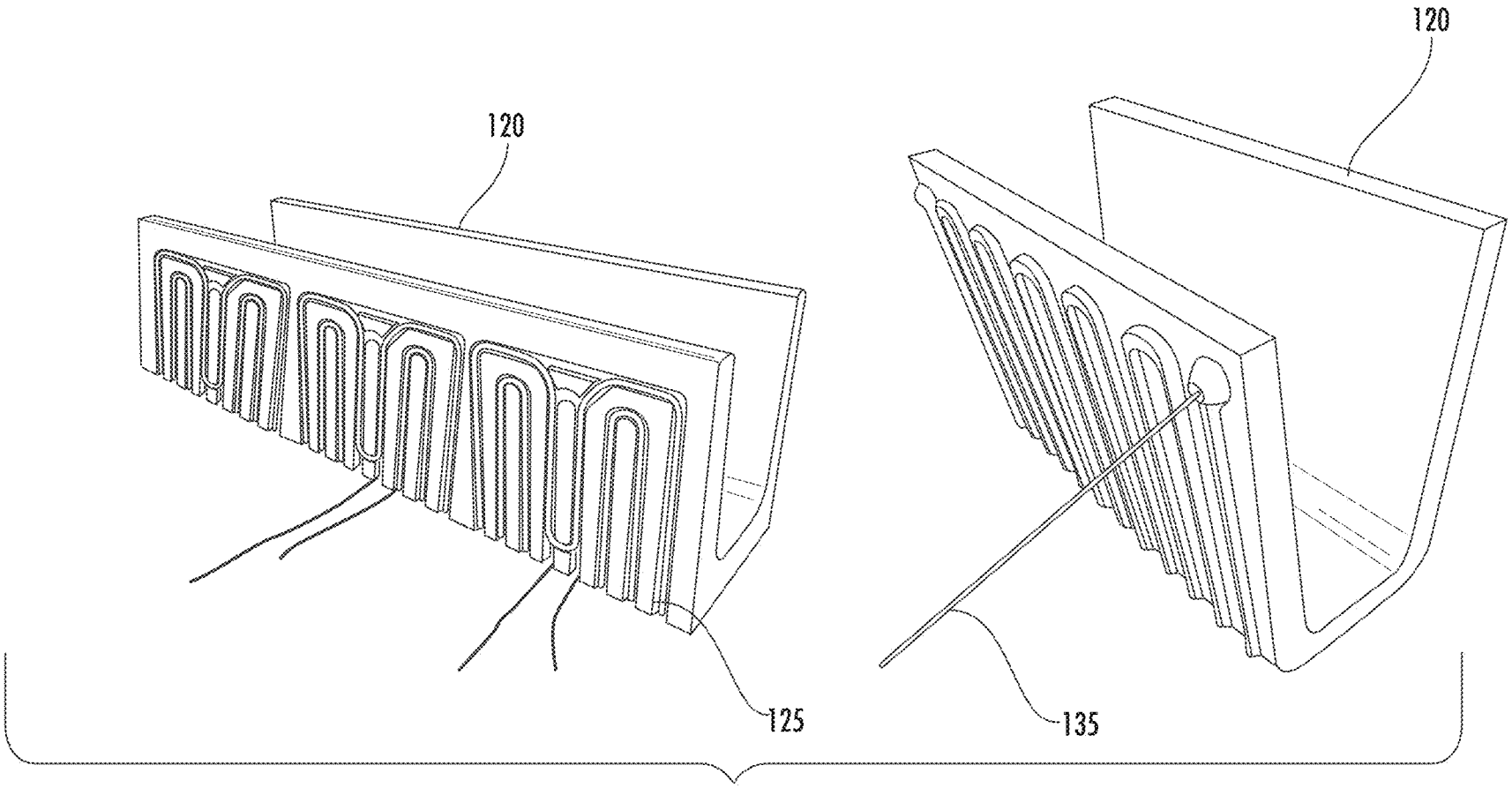
Figure 6:
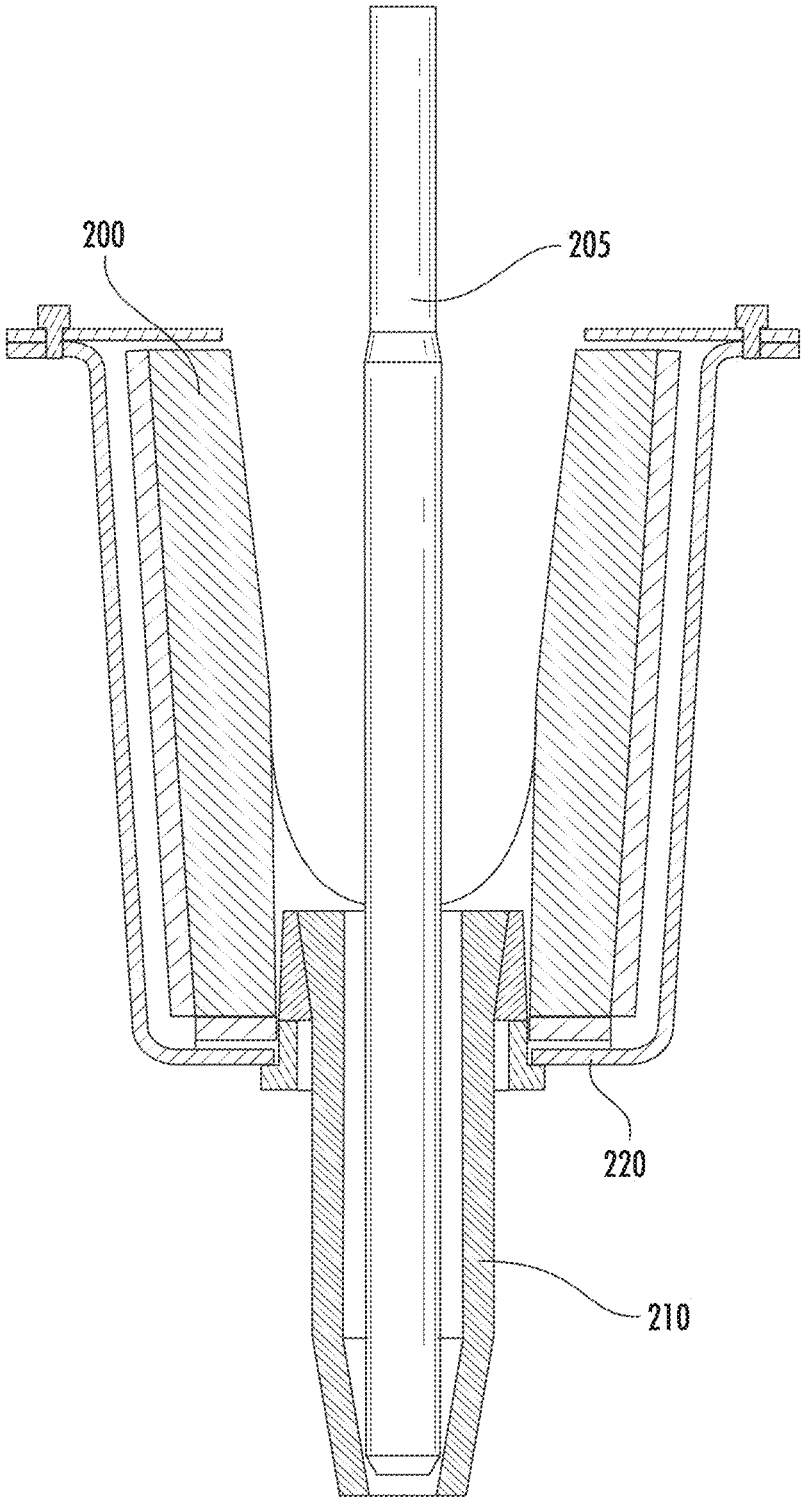
Figure 7:
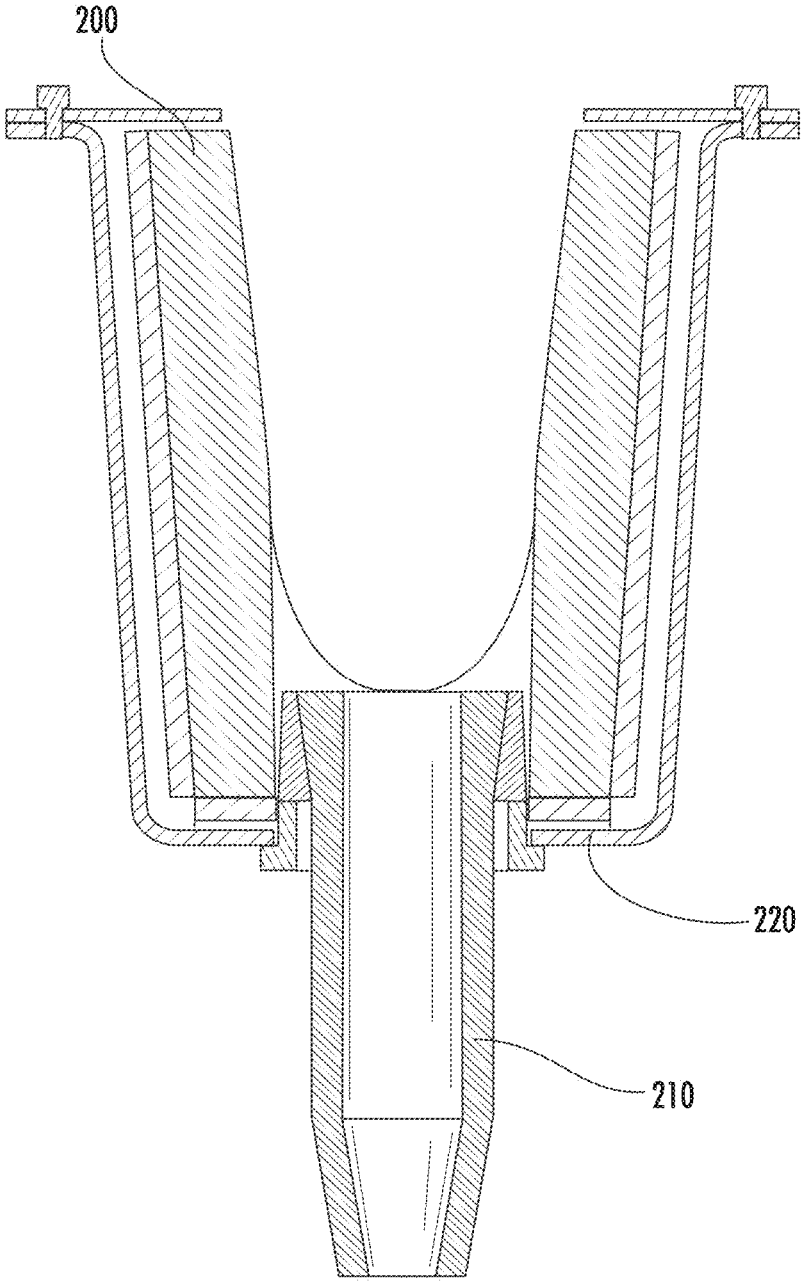
Figure 8:
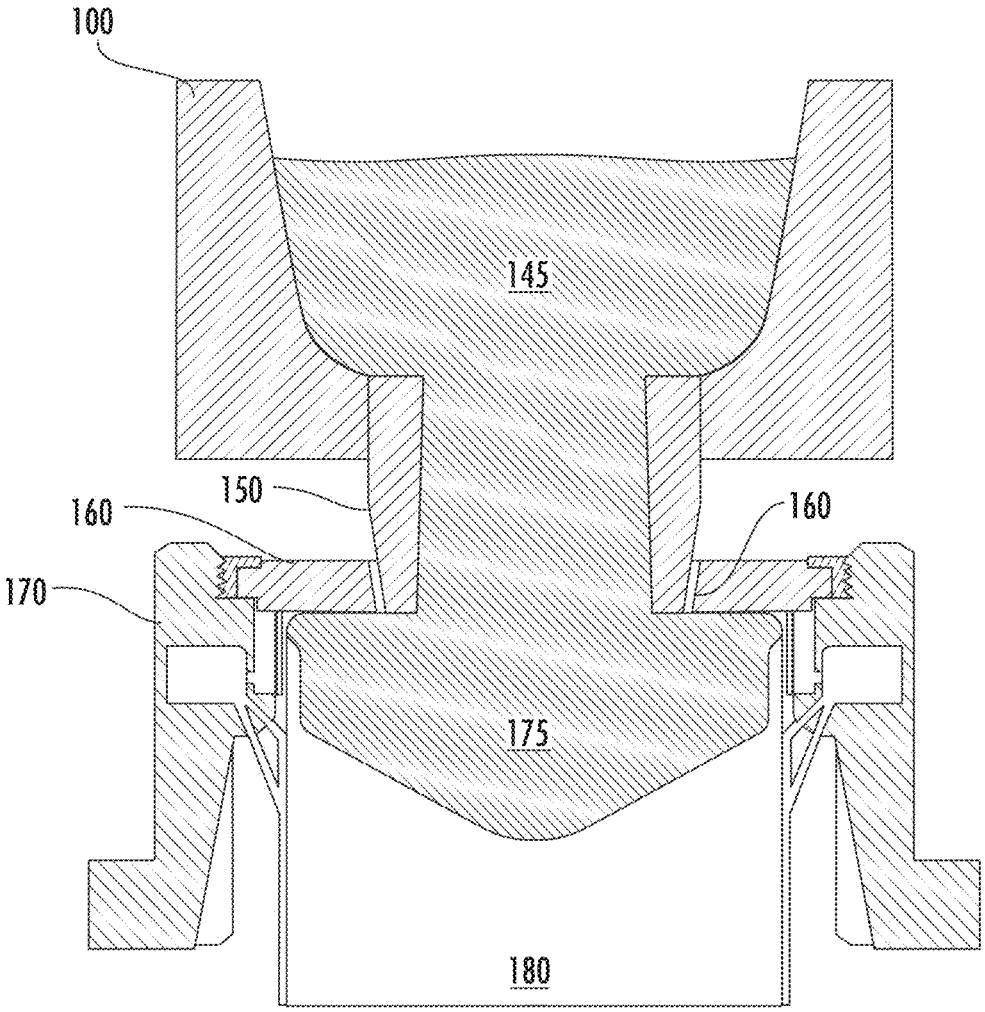
Figure 9:
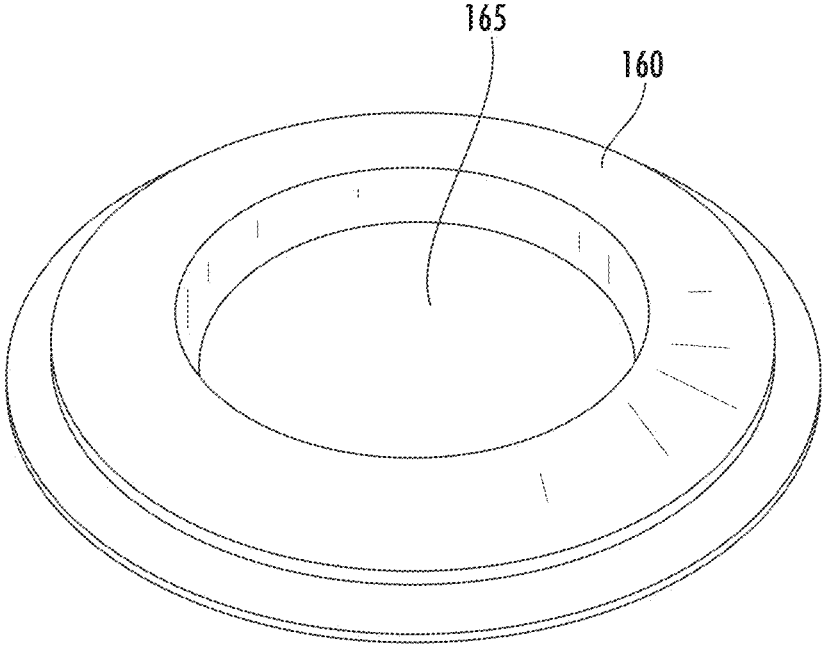

Having thus described the invention in general terms, reference will now be made to the accompanying drawings, which are not necessarily drawn to scale, and wherein:

FIG. 1 illustrates a refractory channel that includes a working surface that is in contact with molten metal as it flows through a trough according to an example embodiment of the present disclosure;

FIG. 2 illustrates a refractory channel that includes a working surface that is in contact with molten metal as it flows through a trough without requiring a backer according to an example embodiment of the present disclosure;

FIG. 3 depicts a portion of a refractory channel including the core with channels defined therein for heating elements according to an example embodiment of the present disclosure;

FIG. 4 illustrates a refractory channel inverted with a cast backer applied according to an example embodiment of the present disclosure;

FIG. 5 illustrates a core molded with heating elements molded into the molded core with the electrical leads exposed according to an example embodiment of the present disclosure;

FIG. 6 illustrates a cross-section of a trough for direct chill casting including a spout extending from the trough and a pin extending into the spout according to an example embodiment of the present disclosure;

FIG. 7 illustrates the cross-section of the trough and spout of FIG. 6 with the pin removed according to an example embodiment of the present disclosure;

FIG. 8 illustrates a billet casting section view with a refractory channel having molten metal flowing through a thimble and a transition plate into a cavity of a billet mold according to an example embodiment of the present disclosure; and FIG. 9 illustrates a transition plate according to an example embodiment of the present disclosure.

DETAILED DESCRIPTION

Example embodiments of the present disclosure now will be described more fully hereinafter with reference to the accompanying drawings, in which some, but not all embodiments of the disclosure are shown. Indeed, embodiments may take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a system, apparatus, and method for producing refractory products, and more particularly, to producing heated refractories, passive refractories, T-plates, moldable refractories, and accessories such as heated spouts, heated pins, thimbles, and dams. While the figures and disclosure focus on an exemplary embodiment implemented as a refractory channel or trough, embodiments may be implemented in various other components of a casting operation for handling of molten metal. As noted above, these components may include, among others, heated spouts, transition plates, and components such as furnace launders, ingot launders, billet tables, etc. As such, the primary embodiment described herein should be illustrative of the structure of heated refractory components and not limiting to those illustrated in the figures.

Casting operations for casting metals typically involve the transport of molten metal from a furnace to molds. For example, in direct chill casting, a mold table may include an array of billet molds where numerous billet casting molds may be arranged within a mold table. The introduction of molten metal to each of the casting molds involves transporting the molten metal from the furnace to each mold cavity. The molten metal is generally introduced first at one side of a mold table, and flows along refractory channels to reach each mold cavity. However, the molten metal temperature varies across the refractory channels across the mold table as the molten metal cools relatively rapidly as it flows along the refractory channels, despite the refractory material of the channels insulating the molten metal. This temperature variation across distribution points of a casting operation can be detrimental to the casting process.

Metal temperature control is a key functional requirement of a refractory channel or refractory system. Ideally, molten metal temperature would remain constant from the furnace all the way to the mold where it will eventually cool and solidify. Minimal temperature drop is desirable. However, real-world refractory channels absorb some heat from the molten metal and cools the metal. This heat loss can be compensated for with increased furnace temperatures; however this could degrade the quality of the casting and increase cost, while still having variability in the molten metal temperature across the plurality of molds.

Embodiments provided herein include refractory channels, systems, and products that minimize or eliminate temperature loss in molten metal as it is transported to mold cavities. An example described herein includes an internally heated refractory materials. Embodiments may include electric heating elements integrated within the refractory material that handles molten aluminum. The internal heating elements allow precise temperature control of the refractory material where the refractory material can be preheated to avoid sudden temperature drop in molten metal when it is first introduced to the refractory material, such as into a refractory channel. Further, the refractory material can be heated for steady-state molten metal flow through a refractory channel or accessory (e.g., thimble, spout, etc.). Heat may be continually applied to the refractory material to compensate for losses from convection and radiation.

Embodiments described herein offer greater control of material flow and consistency than with passive (non-heated) refractory channels.

FIG. 1 illustrates an example embodiment of a refractory channel 100 that includes a working surface 110 that is in contact with molten metal as it flows through the trough 105. The working surface may be covered to block radiation and convention. A material such as aluminum foil can provide the radiation and convection blocking for the working surface 110. The refractory channel further includes a core 120 that is of dense refractory material proximate the working surface. The core 120 may be around 0.5 to 1.0 inches thick. A backer 140 of lightweight insulation supports the core 120 and may be bonded to the core. Electric heating elements 130 may be disposed between the core 120 and the backer 140. The electric heating elements 130 may be of a variety of configurations, such as a conductive wire of about 0.2 inches in diameter. The refractory channel 100 may be installed within an insulated steel frame.

FIG. 2 illustrates another example embodiment of a refractory channel 100 that includes a working surface 110 that is in contact with molten metal as it flows through the trough. The refractory channel includes the core 120 proximate the working surface 110; however, the embodiment of FIG. 2 does not require the backer 140 of FIG. 1. Conversely, the electric heating elements 130 are embedded within the core material as will be described further below, thus not requiring a backer material.

Embodiments described herein are designed to heat the working surface 110 of a refractory channel 100 with the disclosed heating system. It is desirable to have a temperature of the working surface 110 within a predefined degree of similarity of the molten metal that is to flow through the trough 105 such that there is no heat transfer between the working surface 110 and the molten metal flowing through the channel 100. This predefined degree of similarity may be a temperature range or a percentage, such as a degree of similarity of five percent, two percent, or even one percent. Optionally, the working surface 110 temperature may be maintained a predetermined amount above the temperature of the molten metal to compensate for heat lost from the molten metal through convection and radiation. The working surface 110 of example embodiments is a relatively hard material that is not susceptible to damage from steel cleaning tools such as steel brushes and scrapers. Further, the working surface 110 may be relatively smooth to avoid molten metal adhering to surface imperfections or roughness. A smooth working surface 110 aids in cleaning after casting. According to some embodiments, the working surface may be treated with a hardening coating, such as colloidal silica mixed with silica aggregate, to close the pores of the working surface and to increase hardness. Further, a coating of boron nitride may be painted on the working surface 110 to render the surface non-wetting to aluminum.

The core 120 of the refractory channel of example embodiments is employed to balance contrary objectives. The core 120 of embodiments described herein is of a material strong enough to resist steel cleaning tools including prying and impact forces and thermally conductive to effectively receive heat from the heating elements 130 without overheating the elements. While these properties suggest a high density material, the material of example embodiments also has a low thermal capacity such that it will preheat more quickly. Further, the core 120 material may have a low thermal conductivity and low thermal capacity such that it will absorb little heat from the molten metal flowing through the trough 105 when the temperature of the core 120 is low. These properties suggest a low density material. Embodiments described herein provide a core material that includes the addition of microbubbles (or the use of foam or a filler such as fine cellulose), while toughness is achieved by the addition of refractory fibers.

FIG. 3 depicts a portion of an example embodiment of the refractory channel 100 including the core 120 with channels defined therein for the heating elements 130 which are powered by power supplied via electrical leads 135. The illustrated core 120 with a working surface 110 would receive a backer 140 to encase the heating elements 130 and insulation 150 outside of the backer. The density of the core 120 of example embodiments described herein may have a density of about 1000 kilograms per cubic meter to about 1,500 kilograms per cubic meter. Lower densities may not be strong and durable enough, while higher densities offer little benefit to strength.

The backer 140 of example embodiments described herein, while not necessary in all embodiments as illustrated above with respect to FIG. 2, has several functions. The backer 140 insulates the back side of the core 120 to thermally isolate the core. The backer may physically support the core and protect against molten metal leaks from the refractory channel. Backing material may include a dry insulation material such as granular microporous insulation and/or a lightweight castable material. Microporous granular insulation has a low thermal conductivity and offers very good thermal performance; however, it does not provide effective scaling against molten metal leaks. A lightweight castable material, such as a colloidal silica mixture is more thermally conductive than microporous insulation, but has the advantage of firmly bonding to the core for excellent reinforcement and shielding from molten metal leaks. The lightweight casting material may be of a relatively light density, such as between 500 kilograms per cubic meter to 1,000 kilograms per cubic meter to maximize insulating value while retaining sufficient physical competency to support the core 120. The backer 140 of example embodiments may be applied when the core is physically installed in a final location, such as when installing a refractory channel into a steel frame or steel trough frame that may be insulated with microporous boards of a half inch thickness or more. FIG. 4 illustrates a refractory channel 100 inverted with a cast backer 140 applied.

The electric heating element of example embodiments applies heat to the working surface. In this manner, the molten metal temperature of molten metal flowing through the refractory channel 100 is held constant within the channel. The element 130 is a resistance heating wire, which may be nichrome 80 or Kanthal A1, for example. The wire diameter of the electric heating element 130 may be about 0.03 to 0.05 inches, for example, and may be formed into a coil, which may have a coil outer-diameter of about 0.2 inches. The coil aids in shaping the element and adds more physical length to the wire to increase the total resistance.

According to some embodiments, a heated refractory channel 100 may be made with resistance heating wire that does not have coils. Such an element requires less overall thickness which can improve thermal performance. However, the straight wire is more difficult to fabricate. A coil form for the element 130 is generally preferable due to the ability to stretch allowing another degree of freedom in the design and installation process resulting in a greater degree of standardization. The same coiled element may be employed in most heated refractory components (e.g., channels) on a project and stretched to different pitch for each unique part, and resulting in easier installation since coils can be pressed into grooves or stretched around posts far more easily than straight wire. The heating elements 130 of example embodiments may be designed for five watts per square inch of working surface, for example. In such an embodiment, a twenty inch long refractory channel may have a working surface 110 area of 500 square inches which would be heated with 500 to 2,500 watts. From testing, this heat flux achieves very high temperatures (e.g., above 900 degrees Celsius) at the working surface with preheating times of as low as 30 minutes depending upon the core 130 material and the backer 140 material. Embodiments may employ heating of five watts per-square-inch or as little as one watt per-square-inch depending on application, which may improve cost and durability.

The heating element 130 may be controlled with a loop controller and switch. The feedback may be a type K thermocouple installed within proximity to the heating element and work surface 110. According to an example embodiment, a thermocouple may be installed inside the coil of the heating element 130 using a thin alumina tube as a dielectric. Optionally, a stainless steel thermowell inside the coil may be employed which adheres to the core using refractory mortar for good thermal coupling. The thermocouple is used to read the hot face of the core which indicates the element temperature. Controlling the element temperature may be useful to protect from overheating and to stabilize the system to avoid over/under-shooting the desired temperature. Indirectly, this controls the temperature of the working surface. It may not be practical to measure the working surface temperature for the feedback loop as the working surface is in contact with molten metal. Embodiments may be designed to run at low power, such as at one watt per-square-inch, without any temperature control. The design and configuration could prohibit overheating such that the feedback loop may be rendered unnecessary.

The heated refractory channel 100 employs insulation 150 to reach and maintain high temperatures. A frame supporting the refractory channel 100 may be insulated from the channel by an insulation such as a half-inch thick microporous board or equivalent. The working surface 110 of example embodiments is covered with a material that inhibits convection and radiation heat transfer where even aluminum foil may be sufficient. In the absence of proper insulation 150, the system may not achieve the high temperatures needed for optimum results. While a steel frame for supporting the refractory channel 100 may be used, a cover may be omitted from the refractory channel. For example, on a direct chill casting table with a plurality of billet mold cavities, clear visibility to the billet mold cavities may be more important than maximizing a preheat or maintaining heat of a refractory channel. In the absence of a cover, the working surface 110 may achieve a temperature of 400 degrees Celsius or greater where molten aluminum is approximately 700 degrees Celsius. Despite the temperature difference, a preheat of 400 degrees Celsius is valuable and directly beneath the working surface the core 120 could be heat soaked to a much higher average temperature, closer to 700 degrees Celsius, such that the bulk of the refractory channel 100 is near the metal temperature to improve casting consistency. Embodiments may use an engineered cover over the refractory channels to omit a temperature controller and run full-power with a low-power configuration. For example, a low-powered trough could be designed to run continuously at one watt per-square-inch without any cover so that the internal temperature never overheats.

An integrally heated refractory channel as described herein preheats relatively quickly and with relatively low power consumption based on the design and configuration described above. Embodiments hold the working surface 110 at or near the metal temperature. A heated refractory channel 100 of example embodiments may include a working surface heated to a metal temperature of 700 degrees Celsius. The preheat may be relatively quick and require relatively low power due to the heat being directed to the working surface through the construction of the channel and the casting consistency would be improved since heat is not being transferred from the molten metal to the heated refractory channel or vice versa.

According to example embodiments described herein, the working surface 110 is isolated and heated by a heating element 130 configured at a proper relative position. The distance between the heating element and the working surface may correspond to the thermal resistance to the objective and the thermal mass of the objective. As the heating element 130 position is closer to the working surface 110, the thermal resistance and the thermal load are reduced. The heating element 130 of example embodiments may be positioned as close as possible to the working surface. In real practice, some separation is required as the molten metal is electrically conductive and must not make physical contact with the heating elements 130. The separation distance between the working surface 110 and the heating element 130 varies by application. A large refractory channel 100 may require a half inch of material thickness between the heating element 130 and the working surface 110 whereas a spout made of refractory material may only need a quarter of an inch of material between a heating element 130 and a surface of the spout in contact with the molten metal. The position of the heating element 130 relative to the working surface in contact with molten metal is a balancing act. Closer proximity improves performance at the expense of the heating element exposure and core 120 durability.

Heat from the heating element 130 is transferred in all directions from the element. The proportion of heat is divided according to the temperature gradient and the thermal resistance of each vector relative to the others. Where the ratio of temperature gradient to thermal resistance is highest, those vectors receive the greatest heat. Ideally, all heat would transmit to the core 120 and the working surface 110 while none would be transferred to the backer 140. To accomplish this or approach this scenario, the backer 140 of example embodiments possesses a greatly reduced heat transfer coefficient relative to the refractory channel at the working surface. The backer 140 of example embodiments may have a level of conductivity that is a magnitude less than the core 120 such that the core will receive most of the power and heat from the heating element 130. Proximity of the heating element 130 to the working surface 110 reduces thermal demand, while isolation of the heating element 130 from the backer 140 increases the thermal supply or proportion of the heat from the heating element available for the working surface.

As illustrated above with respect to FIG. 2, embodiments may not require a backer 140 and the heating element 130 may be entirely encased in the core 120. In such an embodiment, encasing the heating element 130 within the core 120 can protect the heating element from damage. The insulation 150 may provide some functionality similar to that of the backer by insulating the core 120 to promote heat migration toward the working surface 110. The structural support provided by a backer 140 may be provided by the core 120 material and by added thickness of the core material used to encase the heating element 130.

The process for improving proximity and isolation of the heating element from the environment is generally contrary to the durability of the refractory and resistance to molten metal leaks. Proximity promotes a thin core 120 and isolation promotes lightweight backer 140 material that provide less support. A heated refractory as described herein has two primary potential failure modes: structural failure and electrical failure (of the heating element). The heated refractory channel 100 and other heated refractory components endure physical trauma/abuse in the form of steel tools prying, impacting, and cleaning and pneumatic dams collapsing down along with other physical forces. The heating elements need to be shielded from the molten metal which would attack and destroy a heating element. Molten metal can invade a heating element channel through a crack in the core 120 or leak into a heating element channel through failures in a joint between channel components. A thicker core 120 and more durable backer 140 improves durability but sacrifices proximity positioning and isolation of the heating element such that performance may suffer.

Embodiments described herein provide a cast-in-place backer to satisfy structural, electrical, and thermal demands. Casting in place enables the backer 140 to ideally fill the void behind the core 120 to support the core consistently. The core 120 is thin, but relatively hard, while the backer 140 may be compared to a mortar that bonds and seals to the core. The insulation and frame provide structural support for the heated refractory channel with the insulation ultimately isolating the assembly.

Electric heating elements often have a relatively short life span in molten metal casting. Corrosion with oxygen eventually destroys electric heating wires. Chromium from the wire may create a protective barrier, chromium-oxide, that shields the wire from further corrosion. However, this thin oxide layer is fragile and may crack from mechanical stresses that can be induced by vibration, impact, or other deflections. Mechanical stress may result from rapid quenching of the wire as the thermal expansion of chromium oxide is much less than that of the base metal, where quenching causes a temperature gradient where the outside is colder than the inside and by thermal expansion, the oxide layer is cracked.

Embodiments described herein with heated refractory components protects the heating element 130 from these effects by encapsulating the heating element within the motionless and temperature-stable refractory. In most applications, the heated refractory may be completely stationary. However, even in applications where movement is necessary, such as with tilting tables in direct chill casting, the heating element is physically constrained by stiff refractory materials such that deflections are inhibited. Further, the refractory may provide a buffer for air quenching resulting in less temperature shock of the heating element. The heating element is protected as the refractory is somewhat heavy and insulating such that the element does not suffer the quenching directly.

Heating element 130 life is also dependent upon temperature as thermal energy drives corrosion. The element temperature of example embodiments is minimized by the principles of proximity of the heating element 130 to the working surface 110 and the isolation of the heating element from the environment. Element temperatures of example embodiments generally remain below 900 degrees Celsius. Nichrome and Kanthal A1 begin to degrade above 1,000 degrees Celsius. Further, isolation of the heating element either between a backer 140 and a core 120 or entirely within the core 120 improves efficiency of heating such that elevated temperatures above a point where degradation may start is not necessary. According to example embodiments described herein, the working surface 110 of the refractory channel 100 is maintained above the solidification temperature of the molten metal flowing through the channel. For aluminum, this temperature may be about 660 degrees Celsius, such that the working surface may be maintained above this temperature, and preferably above 685 degrees Celsius to avoid pre-solidification, such as at about 700 degrees Celsius to compensate for losses and to supply the metal at the required temperature. To maintain a working surface at about 700 degrees Celsius, the heating element 130 is heated to a temperature above the needed temperature at the working surface 110.

The increment to which the heating element 130 needs to be heated above the target temperature of the working surface 110 is dependent upon the efficiency of the heated refractory channel 100. Embodiments described herein have a very high efficiency of heat transfer to the working surface from the heating element due to the proximity of the heating element to the working surface and the isolation of the heating element. Thus, the increment to which the heating element 130 needs to be heated above the target temperature of the working surface 110 is relatively small, such as 50 degrees Celsius to 100 degrees Celsius. This maintains the heating element below 900 degrees Celsius and well below the temperature at which the heating element would begin to degrade, generally around 1,000 degrees Celsius.

Manufacturing of the core 120 described herein may be performed in a number of manners. For example, a core may be cast with grooves on the back side where an electric heating element may be fitted into the recessed grooves of the core. The heating element 130 coil may be shaped within the mold itself prior to casting of the core 120 using studs, where the coil is stretched around studs within the mold. In such an embodiment, the studs may be integrated within the mold and may retract from the mold after casting to permit demolding. Studs may be embodied as screws, dowels, pins, etc. Alternatively, before casting the heating element may be embedded within female recessed grooves of a silicone core mold. Alternatively, a pre-shaped coil may be pressed into the castable core during casting. The castable itself may hold the coil in place according to example embodiments described herein. FIG. 5 illustrates an example embodiment of a core 120 that is cast with grooves 125 to receive a heating element 130 therein. FIG. 5 also illustrates a core 120 molded with heating elements molded into the molded core with the electrical leads 135 exposed.

Molding of a core 120 may be performed with silicone molds as they are durable, form excellent details, and can demold from intricate shapes such as grooves. To produce a silicone mold, a three-dimensional print of the part geometry is made. A box may be built to support the print and the eventual silicone mold. Using the box, silicone is cast around the 3D print to form a negative of the part geometry. Once the silicone is cured, the 3D print part is demolded and the silicone mold is rebuilt ready to cast refractory material. The refractory material is then cast into the silicone mold. Heating elements are fit into the refractory groove after casting or into the silicone groove before casting the refractory depending upon whether the heating element is to be adjacent or embedded. After the refractory material cures, it is demolded and the silicone mold may be rebuilt for a subsequent refractory casting. The 3D print used to make the silicone negative can produce highly detailed geometries such as narrow grooves to capture the heating element 130. Optionally, molds may be three-dimensionally printed, machined from aluminum, or formed through other mold-forming techniques.

Embedding the heating element 130 into a casting of the core 120 can be a highly efficient process. An inner shape of the working surface 110 may be printed three-dimensionally or recovered/salvaged from a previous job. The heating element 130 may be preformed by stretching to shape and annealing the element with current applied through the element. The core material may be mixed for casting with a sufficient consistency to hold shape without slumping. The core material may be applied to the working surface to half-depth and the material may be shaped with a scraper for relatively consistent thickness. The pre-formed heating element may then be pressed into the core material, preferably with a visual guide or template to improve efficiency and accuracy of laying out the element. The rest of the core material can then be applied to the working surface to cover the heating element. Current may be applied to the heating element to decrease cure time. This process requires less cost and fewer parts to build a mold and to produce a casting of the core than alternative methods.

Various materials may be used in example embodiments of refractories, where the materials may include a silica based refractory that has low thermal expansion, compatibility with molten metals such as aluminum, thermal conductivity in the range of one watt per meter Kelvin (1 W/m-K), adequate temperature capacity and strength, and is widely available and affordable. The low thermal expansion renders the material thermally stable and resistant to temperature cracking. The natural thermal conductivity desired is to be compatible with the heating element designs.

The materials used for the refractory may include binders of calcium aluminate cement and/or colloidal silica. The binders provide strength in the green state (e.g., the cured condition prior to firing. The part must be capable of being demolded and handled to the furnace without breaking apart. When the part is baked in the furnace, full strength is achieved by localized sintering at elevated temperature, after which the binder becomes less relevant.

Calcium aluminate cement and colloidal silica are very different. The cement works by chemical reaction with water similar to Portland cement. The cement product provides excellent green strength; however, the high temperature durability of the cement is poor so the final part may be weakened. Colloidal silica hardens as the water content evaporates and precipitates 15 nanometer particles in solution. Since the water displaced air, the particles bond by vacuum. Drying the water causes the part to harden. This can be done through natural evaporation, which may take a day or more depending upon the geometry. With natural evaporation, the water migrates as it dries so that the surface becomes very hard due to the silica particles migrating with the water. Alternatively, the parts can be rapidly dried by applying heat such as convection, radiation, or even microwave power. This can cure parts in seconds or minutes so that the water does not migrate and the part is more uniformly hardened. Rapid drying may tend to cause steam eruptions which can damage the part, such that drying quickly requires knowledge and understanding of the process and the geometry of the parts. Embodiments described herein can employ the heating elements within the core 120 to heat and dry the material for drying uniformly typically in under an hour.

Rapid curing of refractory material may improve productivity by enabling a mold to be used more frequently. Typical curing time may be twelve to twenty-four hours; however, rapid curing can reduce the curing time to less than an hour and in some cases, mere minutes. Embodiments described herein may reduce curing time through the use of heat and salt addition. Heat supplied by the integral heating coil can be readily applied since the components being molded are themselves capable of being heated. Optionally, a mold may be placed within a furnace for curing. For colloidal silica castings, the heat drives out the water effecting hardening and minimizing migration of the hardening particles. For cement castings, the heat increases the rate of chemical reaction. The effect is pronounced for colloidal silica castings as using high heat can result in castings hardening within minutes. Through the addition of salt, such as table salt, colloidal silica castings will gel. The process is sensitive to the salt content and temperature. Using a low salt concentration, such as less than one percent by mass, the casting will gel very slowly at room temperature, which allows operators to work the product into molds. When the casting is heated to about 50° C., the casting will gel rapidly within minutes. There are two primary benefits to gelling: (1) if the gel is made very hard then it can be demolded immediately, and (2) gelling prevents migration of the hardening particles. Ordinarily, as the colloidal silica evaporates, the moisture migrates to the free surface where evaporation takes place and the migration takes the hardening particles with it. The free surface then becomes very hard and strong, while the remainder of the part is weakened. Gelling prevents this migration so that the part is uniformly hardened which is beneficial to most molds as molds generally cannot breathe and the part may require hardening where the mold cannot breathe.

Refractory materials may be brittle such that incorporation of fibers such as refractory ceramic fibers (RCF) may be used in the material. The fibers may be blown alumina silicate fibers that are unlubricated such that they absorb water. The fibers may first be mixed into a slurry with the water, then mixed with the refractory material mix. Fibers substantially stiffen the wet castable material which can be useful, particularly when combined with the below-described micro bubbles. The fibers give the wet mix a structure that can be shaped freely without a mold.

Silica particles may be added to the refractory material as the aggregate. These may be silica aggregate or silica grains that differ in magnitude of the particle size. Finer particles can produce more detailed parts which may be important for coil grooves, but larger grains may add substantial strength. These aggregates may form the bulk of the castable for the cement mix, similar to Portland mix with gravel or sand, but for the colloidal silica they are a smaller component added mostly to yield good surface finish and detail. In addition to silica, other particles may be used such as alumina aggregate and colloidal alumina. Alumina can be used to improve the temperature capacity and strength of the refractory material.

According to example embodiments provided herein, microbubbles may be added to the refractory material to reduce density and to improve the shapeability of the refractory material. Microbubbles are hollow glass bubbles having a diameter of about 60 micrometers and a thickness of about half of a micrometer. These microbubbles can withstand fluid pressures of up to 200 pounds per-square-inch making them suitable for ordinary refractory mixing and casting. Microbubbles can further withstand light pumping. Microbubbles reduce the density of refractory castable material such that a density of less than 500 kilograms per cubic meter can be achieved from a material that has a typical density of over 1,800 kilograms per cubic meter, while retaining a smooth finish, invisible porosity, and moderate strength. The strength is greatly improved by hardening the surface with colloidal silica and aggregate. Parts can be made to be very light weight while having remarkable strength.

Microbubbles make the refractory material more shapeable, more smooth, and more crack resistant. With the proper water content, the mixture can be shaped by hand and will hold shape until dried. This provides a useful stiffness by rending the material light enough to support itself and not flow under its own weight. Further, the mixture does flow easily when motivated. The microbubbles are generally spherical so they are able to roll with little resistance and the mixture can spread like warm butter. This shapeability is useful as a 'moldable' material that may be useful for repairing a refractory part, filling joints, filling holes, or freeform shaping of parts in place. The material is also useful for original casting processes.

Microbubbles tend to soften and flow at very elevated temperatures, such as above 600 degrees Celsius, such that they are not used in refractory materials. However, even when microbubbles soften and flow, they leave behind very fine voids. The microbubbles may fail, but the void shaped by the surrounding colloidal silica and silica aggregate will persist. The porosity is invisible to the eye and parts appear solid even when they are 80% air. The corresponding thermal properties of low thermal conductivity and capacity are desirable for refractory purposes, and depending on the density these parts can be made very strong, particularly by surface hardening with colloidal silica and silica aggregate. These invisible pores can endure temperatures of about 1,000 degrees Celsius with no apparent degradation. However, when temperatures reach 1,200 degrees Celsius, sintering and coalescence of the pores can occur.

The microbubble mixture described herein of example embodiments is an excellent material for handling of molten aluminum that requires objective temperatures of about 700 degrees Celsius. Using efficient integral heaters, the heater temperatures stay below 900 degrees Celsius rendering the material stable. A mass-based mixture of around 65% colloidal silica, 22% silica aggregate, 8% fiber, and 5% microbubbles has been found to produce a desirable refractory material. This material bonds between the refractory pieces and has good resistance to cracking. This mixture can be varied to produce a wide range of properties. By adding water, the mixture can become free flowing. By adding fiber and microbubbles, the mixture can become dry and stiff to shape onto a mold. A dry mixture may have a composition by mas of: 55% colloidal silica; 25% silica aggregate, 11% fiber, and 9% bubbles.

Parts using the materials described herein may benefit from some form of post treatment. Since the castings generally have some level of porosity by design, closing the pores at the surface may be desirable. This can improve the hardness and the overall strength of the part. A mixture of colloidal silica with silica aggregate is appropriate to seal the refractory. This material may be applied after baking out the part such that it will be very dry and ready to accept the coating. The coating may be mixed such that it is free flowing and relatively runny.

While the primary embodiment disclosed herein includes a heated refractory channel 100 or trough, embodiments of the refractory material and forming process described herein may be used for thimbles, spouts, pins, dams, transition plates, or the like. Essentially, any component of a casting process that uses refractory material and promotes the flow and distribution of molten metal may benefit from the heated refractory component material and forming as described herein. Further, the refractory material described herein may be sufficiently formable and have properties conducive to use as a refractory repair material for repairing cracked and chipped refractory components, and as a material to join refractory components such as joining channel sections. The refractory material described herein is versatile for use as any of the aforementioned components and to join/repair components while being resilient to molten metal. Further, the use of microbubbles in the refractory material, while generally discouraged for use in materials that are exposed to temperatures above 600° C., has been found to provide improved refractory material properties while reducing density, despite exposure to temperatures well in excess of 600° C. Thus, embodiments provide a refractory material using unconventional components and ingredients in a manner different from their intended use to achieve unexpected results that benefit refractory components as described herein.

Spouts to dispense molten metal in continuous casting molds such as ingot molds can lose substantial heat due to their geometry and as they are often made from fused silica, which has a high density and relatively high conductivity. Forming spouts according to the process and configuration described above provides a spout that promotes molten metal flow without the detrimental heat loss.

The example embodiments described above generally include a core, such as core 120 of FIGS. 1 and 2, with heating element 130 disposed within the core. The trough described above may or may not include a backer 140, though the trough of FIGS. 1 and 2 is insulated using insulation 150. Some refractory components may not require the insulation as illustrated and described with respect to the heated refractory channel 100 described above. For example, a spout may not require a backer or insulative material surrounding it as the spout may function as well or substantially as well without such insulation.

The spout 210 is a hollow refractory cylinder which pours molten metal from the trough into a direct chill mold, functioning as a drain at the bottom of the trough channel 200. FIG. 6 illustrates a typical spout 210 and pin 205 within a trough channel 200. The spout 210 is configured to direct molten metal from the channel 200 through a bore of the spout into the direct chill casting mold. The spout 210 may be of various sizes including length and diameter based on the specific configuration. The trough channel 200 may be a heated refractory channel as described above. The trough channel 200 is supported by a frame 220. The spout, as shown in FIG. 6, includes a pin 205 extending into the bore of the spout 210. The pin may be used as a plug to block the outlet of the spout and to prevent molten metal from flowing from the channel 200 through the bore of the spout 210. Raising the pin 205 permits metal to flow through the spout 210 with restriction. Reducing the clearance causes flow to diminish such that the pin position controls the metal flow rate. The cross sectional area may be small at the outlet between the pin and the spout. At the exit of the spout 210, the metal flow velocity is high and produces a thin stream. As a result, heat transfer is very high between the pin and the spout. If the pin and spout are cold, the metal can solidify within the spout and destroy the pin and spout.

The pin 205 of example embodiments may be heated thereby heating the spout, such that regulating the flow of molten metal through the spout with a heated pin reduces the likelihood that the metal will freeze within the spout. However, heated pins are of limited effectiveness. Embodiments herein provide a heated spout to better ensure molten metal doesn't freeze within the spout. Metal freezing within a spout can be costly as a casting operation may be compromised and the spout and pin sacrificed. Embodiments provided herein may include a heated spout that maintains the spout at a sufficient temperature to ensure metal does not freeze within the spout. FIG. 7 illustrates the spout 210 and channel 200 of FIG. 6 with the pin 205 removed.

A heated spout of example embodiments includes a spout cast from refractory material and having an internal heating element. Due to the small size of some spouts, the insulation illustrated in the refractory components of FIGS. 1 and 2 may be omitted. As spouts are generally small, the increased power consumption from not having insulation around the heated spout may be negligible. Embodiments described herein of a heated refractory spout employs a high power density heater, such as about eleven watts per square inch for example. Such a heated spout is able to achieve a temperature of over 540° C. without insulation. An example heated spout may consume less than 1,000 Watts while delivering sufficient heat to ensure metal does not freeze within the spout.

The heated refractory spouts employ a heater encased within the refractory material such that the refractory material protects the heating element from corrosion and damage, while providing structure to the spout. Heated refractory spouts as described herein may optionally include insulation around the outside of the spout to achieve higher temperatures and/or to consume less energy. However, given the relatively low power consumption of a heated refractory spout, such insulated heated refractory spouts may not be necessary. In the event power consumption is a critical factor in some environments and efficiency is a priority, an insulated spout may be preferred; however, it is not necessary according to example embodiments described herein.

Transition plates or plates between a casting thimble and a casting mold cavity in a direct chill billet casting mold are generally a consumable part that is replaced regularly due to cracking and degradation of the transition plate. Transition plates are essential to casting billet such that they may be consumed in large quantities. A lightweight silica transition plate cast from the refractory material described above may resole the cracking problem and greatly improve the transition plate life resolving the core issue of thermal stress while offering a similar manufacturing cost point.

FIG. 8 illustrates an example embodiment of a billet casting section view with a refractory channel 100 with molten metal 145 flowing through thimble 150 through the transition plate 160 and into the cavity of the mold 170 where molten metal 175 solidifies into the casting 180. The transition plate 160 is a disc situated at the top of a billet mold 170. Molten metal enters the mold through an aperture 165 through the transition plate and spreads radially to the full diameter of the billet. An aperture for an eight inch billet casting may be around three inches, for example. The transition plate distributes the metal radially. It is generally a flat ring with an aperture in the middle, where the aperture mates with a thimble to form the piping which feeds molten metal into the mold. The transition plate directly interacts with the molten metal just before it solidifies within the mold. This is a crucial function in the casting process as it is important for the metal to flow without resistance and pre-solidification on the transition plate is detrimental. The transition plate must have a low thermal conductivity and thermal mass such that it does not transfer heat with the metal. FIG. 9 illustrates an example embodiment of a transition plate 160 defining aperture 165.

A bottom face of the transition plate as it interfaces with metal as it flows into the mold while the top of the transition plate is relatively cold as it is part of the water-cooled mold assembly. This temperature gradient is a functional requirement of the transition plate and it is necessary to ensure the metal does not transfer heat to the water-cooled mold before it has reached the final diameter of the casting. The temperature gradient results in stresses according to the coefficient of thermal expansion and the stiffness of the material. Transition plates may be made from graphite reinforced calcium silicate board known as "N17". The coefficient of thermal expansion is listed by the manufacturer as $7\times10^{-6}$/° C. Further, the stiffness of N17 may be high due to the addition of graphite fibers.

Fused silica transition plates predate the N17 transition plate. Fused silica transition plates lasted longer than their N17 counterparts, possibly due to the very low coefficient of thermal expansion of silica which is on the order of $0.5\times10^{-6}$/° C. However, fused silica transition plates tended to absorb heat from the metal and pre-solidify. Fused silica transition plates were prone to casting issues that could compromise a casting, thereby limiting their use for multiple simultaneous strands as a single compromised casting can adversely affect several or all of the castings during simultaneous strand casting. Embodiments described herein employing microbubble recipes can be made to similar density as N17 transition plates, and the thermal conductivity at that density is 29% lower than that of N17. Graphite is highly conductive such that the N17 material has higher thermal conductivity while the microbubbles of the embodiments described herein provide an insulative property resisting thermal conductivity. Microbubble silica transition plates according to example embodiments provide lower thermal expansion rates with improved (reduced) thermal conductivity. Reducing the thermal stresses improves the durability of transition plates formed of the refractory material described herein incorporating microbubbles. Lightweight silica transition plates resolve the cracking problems because of the low thermal expansion and yet still cast well due to the low density of the material.

Beyond the functional improvement of forming transition plates from the refractory materials described herein, the manufacturing may be more efficient with less waste and fewer steps. N17 transition plates are machined from boards, while transition plates described herein can be cast to the final shape or near the final shape to minimize or eliminate machining. For such a casting, an aluminum mold may be divided in two halves and together form a negative of the transition plate shape. The microbubble refractory material may then be pumped into the transition plate mold at a moderate pressure to fill the voids and provide a good surface finish. Heat may then be applied while the material is in the mold to dry the parts within the metal mold. Additionally, the moldability of the microbubble refractory material described herein may be molded to shapes such as a bell-shaped transition plate that combines the function of the thimble and transition plate in one part to more gradually transition the metal from the thimble diameter up to the ring diameter. These curved shapes may have increased strength by virtue of their shape. Such parts are not practical with N17 materials. Forming the transition plates in this manner allows for casting in near-net shapes which may then be machined into transition plates with relatively little machining. Optionally, the material may be cast into boards that may be machined into transition plates, which may be performed when transition plate molds of the size needed are not available.

Embodiments of transition plates provided herein provide a material enabling a large temperature gradient across the transition plate while being lightweight and durable. Embodiments include a lightweight silica transition plate without large pores (e.g., no visible porosity), low density, low coefficient of thermal expansion, and resistant to cracking. The material used for the transition plate may be 90% or more silica by weight with a density of 1,200 kilograms per cubic meter or less. To achieve this density, the material may include microbubbles, such as in the amount of 0.25% by weight or more. To provide enhanced material properties, including causing the material to gel allowing for greater moldability and shapeability, salt may be added to colloidal silica to cause the material to gel. Transition plates formed according to example embodiments described herein provide superior temperature stability while remaining durable and low cost.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for producing a heated refractory component comprising:

casting a core of refractory material in a first mold, wherein the core produced by the first mold comprises a working surface and a back surface, wherein the core is cast with grooves defined within the back surface;

securing at least one heating element coil into the grooves defined within the back surface; and encasing the at least one heating element coil within the grooves.

2. The method of claim 1, wherein encasing the at least one heating element coil within the grooves comprises casting a core backing around the core produced by the first mold within a second mold to form the heated refractory component, wherein the at least one heating element coil is embedded into the heated refractory component.

3. The method of claim 2, wherein the first mold comprises a silicone mold.

4. The method of claim 2, wherein the at least one heating element coil is embedded into the heated refractory component between the core and the core backing.

5. The method of claim 1, wherein the at least one heating element coil is pre-shaped.

6. The method of claim 1, wherein the heated refractory component comprises a trough, the trough comprising a working surface configured to convey molten metal flowing through the trough.

7. The method of claim 6, wherein the grooves defined within the back surface of the core extend along opposing sides of the trough and along a bottom of the trough.

8. The method of claim 7, wherein the at least one heating element coil is secured into the grooves defined within the back surface adjacent to the opposing sides and the bottom of the trough.

9. The method of claim 1, wherein the at least one heating element coil is powered by at least one electrical lead, wherein the at least one electrical lead is connected to the at least one heating element coil within the heated refractory component and exposed outside of the heated refractory component for connection to a power source.

10. The method of claim 1, wherein the at least one heating element coil is completely embedded within the heated refractory component.

11. The method of claim 1, wherein the at least one heating element coil is wound about the back surface and secured in place within the grooves defined within the back surface with studs extending within the first mold.

* * * * *